US007510481B2

(12) United States Patent
Sevon

(10) Patent No.: US 7,510,481 B2
(45) Date of Patent: Mar. 31, 2009

(54) GOLF CLUB

(76) Inventor: David Sevon, Ystadsvägen 127, Johanneshov (SE) SE-121 51

( * ) Notice: Subject to any disclaimer, the term of this patent is extended or adjusted under 35 U.S.C. 154(b) by 212 days.

(21) Appl. No.: 11/552,334

(22) Filed: Oct. 24, 2006

(65) Prior Publication Data

US 2008/0045355 A1 Feb. 21, 2008

(30) Foreign Application Priority Data

Aug. 17, 2006 (SE) ..... 0601694

(51) Int. Cl.
*A63B 69/36* (2006.01)
*A63B 53/04* (2006.01)

(52) U.S. Cl. ..... 473/231; 473/242; 473/251; 473/340

(58) Field of Classification Search ..... 473/231–242, 473/251–252, 340–341; D21/736–746
See application file for complete search history.

(56) References Cited

U.S. PATENT DOCUMENTS

D58,209 S * 6/1921 Bacheller ..... D21/745
2,859,972 A * 11/1958 Reach ..... 473/242
3,459,426 A * 8/1969 Sherwood ..... 473/201
3,979,125 A * 9/1976 Lancellotti ..... 473/233
4,209,172 A * 6/1980 Yamamoto ..... 473/200
4,693,478 A * 9/1987 Long ..... 473/251
4,819,943 A * 4/1989 Szczepanski ..... 473/252
5,167,414 A * 12/1992 Montgomery, III ..... 473/251
5,749,791 A * 5/1998 Passeri, Jr. ..... 473/251
5,820,481 A * 10/1998 Raudman ..... 473/313
5,846,140 A * 12/1998 Hoburg ..... 473/240
5,913,731 A * 6/1999 Westerman ..... 473/251
6,958,019 B2 * 10/2005 Rohrer ..... 473/324
7,407,443 B2 * 8/2008 Franklin et al. ..... 473/251
2006/0014590 A1 * 1/2006 Tao ..... 473/249

* cited by examiner

*Primary Examiner*—Sebastiano Passaniti
(74) *Attorney, Agent, or Firm*—Ostrolenk, Faber, Gerb & Soffen, LLP

(57) ABSTRACT

Golf club, comprising a shaft, which at one end thereof carries a striking head, which on the topside thereof facing the other end of the shaft has a pattern including a first line that extends parallel to a side face of the striking head, which forms a striking surface against a golf ball, two second lines connecting to ends of the first line and diverging at the same angle (α) from the ends of the first line and approaching the stroke surface, the angle (α) being in the range of 5-35.

16 Claims, 1 Drawing Sheet

GOLF CLUB

CROSS REFERENCE TO RELATED APPLICATION

Figure 1:
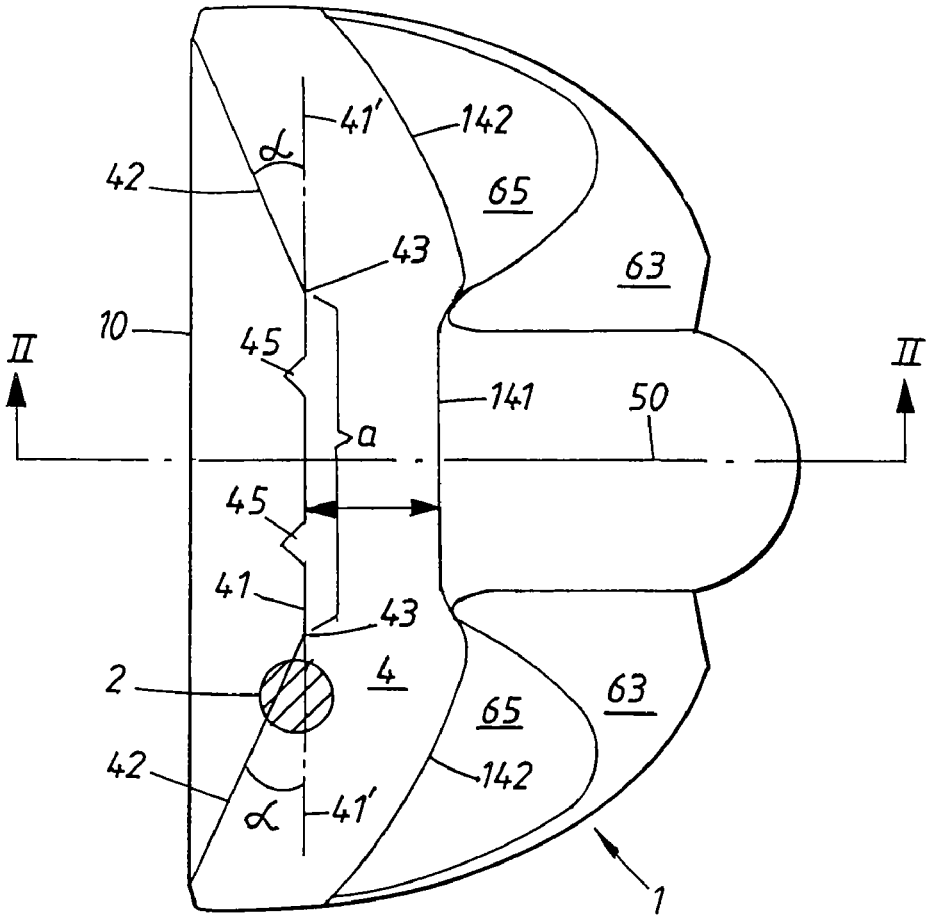

This application claims the benefit of Swedish Patent Application No: 0601694-3 filed on 17 Aug. 2006, the disclosure of which is hereby incorporated by reference.

BACKGROUND OF THE INVENTION

The invention relates to a golf club of the kind that is a golf club, comprising a shaft, which at one end thereof carries a striking head, which on the topside thereof facing the other end of the shaft has a pattern including a first line that extends parallel to a side face of the striking head, which forms a striking surface against a golf ball, two second lines connecting to ends of the first line and diverging at the same angle ($\alpha$) from the ends of the first line and approaching the stroke surface, wherein the angle ($\alpha$) is in the range of 5-35.

Thus, from practice it is previously known to arrange a pattern including lines on the topside of the striking head of a golf putter, with the purpose of assisting a user of the club to direct, upon a stroke motion, the club head in such a way that the ball initially moves in the intended direction. Previously known pattern designs have obviously been selected in an intui-tive way, for instance in such a way that the pattern contains lines that are parallel to the stroke face of the club, perpen-dicularly thereto, i.e., extend in the intended direction of motion of the golf ball, or pairs of lines leaning toward each other, which have a bisector that is perpendicular to the stroke face of the striking head.

However, we have found that the known patterns can be improved, for reasons accounted for hereinafter.

SUMMARY OF THE INVENTION

An object of the invention is to provide a pattern of lines that gives the user of the club particularly good information about the position, angle and motion of the club in relation to a ball upon striking of the ball.

The object is attained by the invention.

Embodiments of the invention are defined in the appended depend-ent claims.

The visual information processing in the brain is carried out in a number of steps from the eye via thalamus along parallel chan-nels to the visual cortex areas V1-V8. From the visual cortex, the information is directed to systems in the temporal and parie-tal lobes, which briefly undertake recognition and localization, respectively. A number of said visual analysis steps are of deci-sive importance for our ability to make good visual judgements that require co-ordination between the eye and the hand, for instance in connection with sports. Golf, and primarily the putting thereof, is an example of a sport and a sport element that makes particular requirements of the co-ordination between the eye and the hand.

By an especially adapted design of the pattern lines on the put-ter, we have found that we can promote the information processing of the sense of sight in such a manner that the user of the club can be allowed to make a better judgement of the position, angle and motion of the club, and particularly the stroke surface thereof, in relation to the ball.

By specifically forming the pattern of lines on the topside of the club head in accordance with the specifications defined in claim 1, the user is allowed to make a particularly good judge-ment of the angle and motion of the stroke surface in relation to the ball upon striking of the ball. In this way, the reliability of the co-ordination between the eye and the hand is enhanced. The pattern according to the invention promotes the processing by the line and motion detectors present in the area V1-V8 of the visual cortex, and in this way offers an optimization of the judgement.

By the invention, it is attained that the special pattern activates more line detectors in said area of the visual cortex than the previously known patterns of lines on golf clubs, in particular putters, according to prior art.

By being able to utilize more line detectors, the following advantage is obtained:

The brain operates with different sensors/detectors to orientate itself, and to make clear and register patterns in the environ-ment thereof. The pattern of lines according to the invention, being a sight pattern, gives a strong difference between the angles, the two second lines and the first line. The line detec-tors of the brain will then react in a meritorious way that makes plain small direction deviations between the intended initial direction of motion of the ball, and the orientation of the club head to said intended direction of motion. In this way, the user is provided a support in respect of moving the club head toward the target at a correct orientation, and furthermore, the accom-plishment of the putting motion is naturally supported.

In practice, the pattern of lines defined in claim 1 means that the pattern offers the advantage of making clear also a very small direction deviation of the normal direction of the stroke surface in relation to the direction of motion of the club head.

Other features and advantages of the present invention will become apparent from the following description of the invention which refers to the accompanying drawings.

BRIEF DESCRIPTION OF THE DRAWING(S)

In the following, the invention will be described by way of examples, reference being made to the appended drawing.

FIG. 1 schematically shows a plan view of the topside of a striking head of a golf putter.

Figure 2:
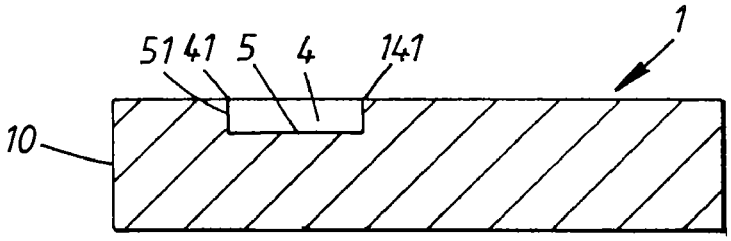

FIG. 2 schematically shows a section taken along the line II-II in FIG. 1.

DETAILED DESCRIPTION OF EMBODIMENTS OF THE INVENTION

In FIGS. 1 and 2, a striking head 1 of a sport club is shown, in particular a golf club, preferably a putter.

FIG. 1 shows a plan view of the topside of the striking head, the point of attachment 2 of the club shaft 2 in the club head 1 being marked with the numeral 2. The club head 1 may be regarded to have an underside that extends surfacewise and is planar, and is generally parallel to a horizontal ground, and positioned immediately above the ground for the striking head 1, when the same hits a ball by the stroke surface 10 thereof.

In the front part thereof, the topside of the club head is shown to have an upper area that is generally plane-parallel to the underside and connects to the stroke surface 10. Furthermore, the topside of the club head is shown to have rear areas 63, 63 that are plane-parallel to the front part of the topside. Transition ramps 65, 65 bridge the front and rear parts of the topside.

FIG. 1 shows a central line 50 that may be regarded to indicate a symmetry plane of the head 1. The line 50 may also be marked as a line of direction, the upper verge of the stroke surface may be shown to extend substantially perpendicularly to the line 50.

On the top surface of the club head 1, a first line 41 is shown that is parallel to the stroke surface 10 and has a length a, the line 41 being divided into two equally long sections by the symmetry line 50. To each end of the line 41, a second line 42 connects at the point 43, which second line extends away from the symmetry line 50 and toward the stroke surface 10, having an angle α to an extension 41' of the line 41. The line 41 has a total length a, which approximately corresponds to the diameter of a ball that is to be hit. Each of the lines 42 may have a length of approx. 20 mm.

The pattern of lines defined by the lines 41, 42 offers a par-ticularly good effect in respect of the possibility of the user of directing the club head 1 in the desired initial direction of motion of the ball that is hit by the stroke surface 1, when the angle α is around 25°. Preferably, the ball (not shown) should be centrally hit with a central portion of the stroke surface 10, i.e., in alignment with the symmetry plane 50, and for such an alignment of the club head, the user may utilize a line mark 50 at the symmetry plane, and possibly, in addition thereto, local deflections 45 of the line 41, which preferably are located at the same distances from the plane 50 and, for instance, are situated approximately halfway between the plane 50 and the respective line end 43. The marks 45 are shown to be in the shape of triangular tips directed forward toward the stroke surface 10. The lines 41, 42 should be clearly marked and thereby visible on the topside of the striking head 1, and may, in that connection, be accentuated in a way that establishes a pronounced contrasting effect. For that sake, the topside of the club head 1 may have a countersink that extends generally over the width of the striking head 1 and receives a filling that contrasts with the surroundings by color or embossment, the lines 41, 42, 45 being defined by the boundary between the filling 4 and the side wall of the channel situated closest to the stroke surface 10.

In practical embodiments, the channel and thereby the filling 4 may have a width of approx. 1.5 cm, but has preferably a width b of at least 3 mm and usually less than 20 mm.

The rear channel wall is generally parallel to the front channel wall, and in FIG. 1, it is can be seen that the rear channel wall has a central, substantially straight portion 141, which corresponds to the front line 41 and two portions 142 connecting thereto, corresponding to the lines 42.

The line 142 does neither need to be straight nor parallel to the adjacent line 42, and the same thing applies for the line 141 in relation to the line 41. However, preferably, the boundary of the filling 4 formed by the line section 141, 142 is mirror-symmetrical in relation to the plane 50. In the example, the connection 2 of the shaft to the striking head is shown to intersect the line 42 near the connection 43 thereof to the line 41, but the location for the connection 2 may naturally be varied within wide limits.

By the fact that the angle α is in the range of 5-35°, an improvement is attained in the ability of the human brain to judge the position, angle and motion of the striking head in relation to the ball, and at an angle α of 25°, an optimum effect is attained.

The club head has been shown to have the line pattern and the marks on a substantially planar front part of the top surface of the club head so that the pattern and the marks are clearly visible to the user of the club upon striking of a ball, but it should be evident that the surface on which the pattern and the marks are arranged does not need to be planar and neither generally parallel to the underside of the club head. The important thing is that the user conceives that the pattern of lines has the described character and the relation to the stroke surface in connection with striking of a ball.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A golf club for engaging a golf ball, the golf club comprising:

a shaft having at one end a striking head;

the striking head including a first side including a stroke surface for the engaging of the golf ball, and a topside facing another end of the shaft;

the topside of the striking head comprising a pattern including a first line extending parallel to the stroke surface of the striking head and having two ends, and two second lines, each second line connecting to one of the two ends of the first line, diverging at an angle α from the one of the two ends of the first line and approaching the stroke surface, wherein the angle α is in a range of 5-35 degrees and the angle α is identical at each of the two ends of the first line, and wherein the first line and the two second lines are all clearly marked to create a contrasting effect with the topside of the striking head.

2. The golf club according to claim 1, wherein the angle α is in a range of 10-30 degrees.

3. The golf club according to claim 2, wherein the angle α is in a range of 20-30 degrees.

4. The golf club according to claim 1, wherein the angle α is in a range of 20-30 degrees.

5. The golf club according to claim 1, wherein the angle α is 25 degrees.

6. The golf club according to claim 1, wherein the first line has a length in a range of 30-45 mm.

7. The golf club according to claim 6, wherein the length of the first line corresponds to a diameter of the golf ball.

8. The golf club according to claim 1, wherein each second line has a length of at least 10 mm.

9. The golf club according to claim 1, wherein the striking head is divisible by a symmetry plane such that the striking head is mirror-symmetrical, except for a point of attachment to the shaft, in relation to the symmetry plane perpendicular to the stroke surface and the first line.

10. The golf club according to claim 9, the pattern further comprising a first visible line deflection of the first line positioned halfway between the symmetry plane and a first end of the first line, and a second visible line deflection of the first line positioned halfway between the symmetry plane and a second end of the first line.

11. The golf club according to claim 1, the striking head comprising a rear side opposite from the stroke surface, a channel positioned between the first line and the rear side, the channel including a filling, a first wall, and an opposite wall closer to the rear side than the first wall, wherein the first line and the two second lines are defined by a boundary between the first wall of the channel and the filling of the channel.

12. The golf club according to claim 11, wherein the opposite side wall of the channel defines, together with the filling, a rear boundary of the filling and the channel extends transverse to the symmetry plane and has a generally constant width of 1.5 cm.

13. The golf club according to claim 1, wherein each second line has a length of 20 mm.

14. A striking head of a golf club for engaging a golf ball, the golf club including a shaft, the striking head positioned at one end of the shaft and comprising:

a first side including a stroke surface for the engaging of the golf ball, and a topside facing another end of the shaft;

the topside of the striking head comprising a pattern including a first line extending parallel to the stroke surface of the striking head and having two ends, and two second lines, each second line connecting to one of the two ends of the first line, diverging at an angle $\alpha$ from the one of the two ends of the first line and approaching the stroke surface, wherein the angle $\alpha$ is in a range of 10-30 degrees and the angle $\alpha$ is identical at each of the two ends of the first line, wherein the first line and the two second lines are all clearly marked to create a contrasting effect with the topside of the striking head, wherein the length of the first line corresponds to a diameter of the golf ball, and wherein the second line has a length of at least 10 mm.

15. The striking head according to claim 13, wherein the angle $\alpha$ is in a range of 10-30 degrees.

16. The striking head according to claim 13, the pattern further comprising a first visible line deflection of the first line positioned halfway between a symmetry plane perpendicular to the stroke surface and to the first line and a first end of the first line, and a second visible line deflection of the first line positioned halfway between the symmetry plane and a second end of the first line.

* * * * *